US007296443B2

(12) United States Patent
Usherovich et al.

(10) Patent No.: US 7,296,443 B2
(45) Date of Patent: Nov. 20, 2007

(54) TOP-LOAD SINK/LAUNDRY COMBO

(75) Inventors: Boris Usherovich, Staten Island, NY (US); Michael Jemal, Brooklyn, NY (US); Shariff Kan, Wayne, NJ (US); Ilya Mosionzhnik, New York, NY (US)

(73) Assignee: Haier America Trading, LLC NY (US)

( * ) Notice: Subject to any disclaimer, the term of this patent is extended or adjusted under 35 U.S.C. 154(b) by 541 days.

(21) Appl. No.: 10/661,932

(22) Filed: Sep. 15, 2003

(65) Prior Publication Data

US 2005/0056059 A1 Mar. 17, 2005

(51) Int. Cl.
*B08B 3/12* (2006.01)

(52) U.S. Cl. ..... 68/3 R; 68/207; 312/228.1

(58) Field of Classification Search ..... 68/3 R, 68/207; 312/228, 228.1
See application file for complete search history.

(56) References Cited

U.S. PATENT DOCUMENTS

| | | | | | |
|---|---|---|---|---|---|
| 2,444,125 | A | * | 6/1948 | Wheeler | 312/270.2 |
| 2,719,071 | A | * | 9/1955 | Wheeler | 312/327 |
| 2,959,044 | A | * | 11/1960 | Stone | 68/12.15 |
| 3,026,699 | A | * | 3/1962 | Rhodes | 68/12.19 |
| 3,039,284 | A | * | 6/1962 | Shelton et al. | 68/3 R |
| 3,039,286 | A | * | 6/1962 | Shelton | 68/208 |
| 3,071,424 | A | * | 1/1963 | Butter | 312/27 |
| 3,230,961 | A | * | 1/1966 | Detterbeck et al. | 134/60 |
| 3,504,683 | A | * | 4/1970 | Leedy et al. | 134/172 |
| 3,927,452 | A | * | 12/1975 | Pouch et al. | 29/283.5 |
| 4,081,915 | A | * | 4/1978 | Materniak nee Babcerowicz et al. | 34/235 |
| 4,115,485 | A | * | 9/1978 | Genessi | 261/119.1 |
| 4,535,610 | A | * | 8/1985 | Fey et al. | 68/3 R |
| 5,253,493 | A | * | 10/1993 | Ohashi | 68/4 |
| 5,706,678 | A | * | 1/1998 | Sasaki | 68/13 R |
| 5,983,520 | A | * | 11/1999 | Kim et al. | 34/261 |

FOREIGN PATENT DOCUMENTS

| | | | |
|---|---|---|---|
| DE | 32 07 410 | * | 9/1983 |
| DE | 34 09 972 | * | 8/1985 |
| DE | 34 29 117 | * | 6/1986 |
| DE | 39 31 226 | * | 3/1991 |
| DE | 296 02 009 | * | 9/1996 |
| JP | 56-27235 | * | 3/1981 |
| JP | 3-75089 | * | 3/1991 |
| JP | 10-23987 | * | 1/1998 |
| JP | 2001-140313 | * | 5/2001 |
| JP | 2003-125959 | * | 3/2003 |
| RU | 2103449 C1 | * | 6/1996 |
| RU | 2106105 C | * | 11/1996 |

* cited by examiner

*Primary Examiner*—Frankie L. Stinson

(57) ABSTRACT

An automatic washing machine including a drum, a sink, connection means for water and drain line, which are assembled in one integrated unit. It looks like a vanity with a built-in laundry machine and could be installed in any bathroom, kitchen or any utility room, mobile home, RV or even a boat having standard provision for sink connection. It could replace any existing standard sink giving customer an additional laundry capability.

8 Claims, 3 Drawing Sheets

TOP LOAD WASHER

TOP LOAD WASHER

Sink is up

Sink is down

WASTE LINE CONNECTION

TOP-LOAD SINK/LAUNDRY COMBO

BACKGROUND OF INVENTION

The vast majority of building apartments have no space and no provision for stationary washers or washer/dryer combo. So the laundry in such apartments is a problem. Portable washer is a kind of solution, but it is always on your way when used and it always takes your valuable storage space when unused.

BRIEF DESCRIPTION OF THE PRIOR ARTS

Washer/dryer combo, with condensation device similar to Automatic washing machine fitted for drying and described in a U.S. Pat. No. 5,588,313 do not requires ventilation, but is too heavy and bulky to be a convenient portable appliance. Well known are also built-in appliances like Compact top loading dishwasher suitable for fitting inside furniture units described in a U.S. Pat. No. 4,739,781. This design requires separate kitchen cabinet.

Stationary sink/washer combination is patented in U.S. Pat. No. 3,026,699, Germany Patents #3409972 and #3429117 and also in Japan Patent # JP403075089A.

Despite that the idea of Sink/Washer combo is generally not new, we don't have this product on a market because of complicated and troublesome installation.

SUMMARY OF THE INVENTION

The invention relates to the field of automatic top-loading washing machines and washer/dryer combo and targeting improvements related to performance, installation and reliable operation.

The Top-load Sink/Laundry Combo consists of an automatic washing machine with or without drying capacity and the sink, which is mounted on the top of the cabinet. All this is assembled in one integrated unit (concealed laundry).

This combination utilizing the space under the sink for laundry machine by re-shaping both P-trap and the sink and provide the user with "Zero-space" stationary washer or washer/dryer combo. It is connected to water supply by standard flexible hoses and to drain line via modified flexible P-trap.

It resembles a vanity with built-in laundry machine under the sink. It could replace any existing standard sink giving customer convenience of laundry capability. An additional advantage of this invention is in increased speed of the drying because a part of hot and humid air from a dryer is directed to the drain line behind the P-trap utilizing drain line's ventilation pipes.

Special water container acting as a part of the drain system used as a counterweight, which decreases vibration caused by drum.

DETAILED DESCRIPTION OF THE PREFERRED EMBODIMENTS

Figure 1:
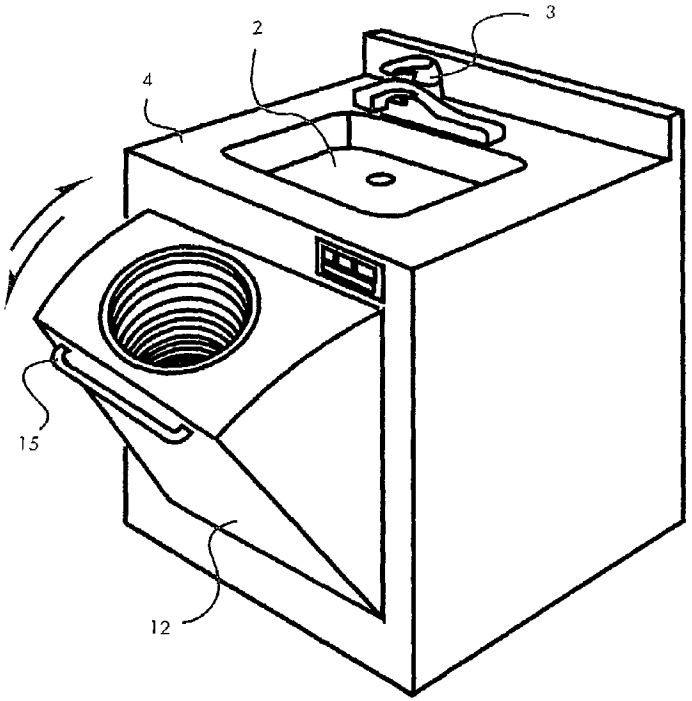
FIG. 1 is an illustrative view of sink and washer combination. The drum with a front panel is shown in open position.
Figure 5:
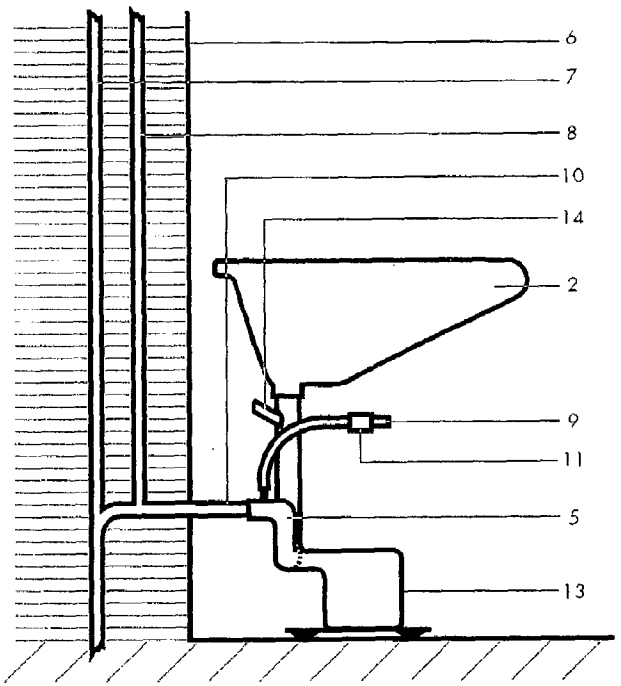
FIG. 5 is an illustrative view of connections to the drain line.

The top-load sink/laundry combo (see FIG. 1 and FIG. 5) consists of an automatic washing machine having a drum 1 and the sink 2 with a faucet 3, which is mounted on the top of the cabinet 4. All this is assembled in one integrated unit.

The unit is connected to water supply by flexible hoses (hook-ups) like typical sink and to drain line 7 by drainpipe 14 via modified flexible P-trap 5. P-trap 5 is located under the sink 2 flush to the wall 6.

Top-load units with horizontal rotation axle of the drum (required for tumbling) could be equipped with a heater, blower and vent and operate like washer-dryer combo.

In a process of drying all hot and humid air could be directed outside via regular or retractable ventilation hose.

When outside ventilation is not available a condensation device could be used. In order to increase the speed of the drying process at least part of the hot and humid air is directed via ventilation hose 9 and coupling 10 to the drain line's ventilation pipe 8 bypassing the P-trap 5.

Figure 2:
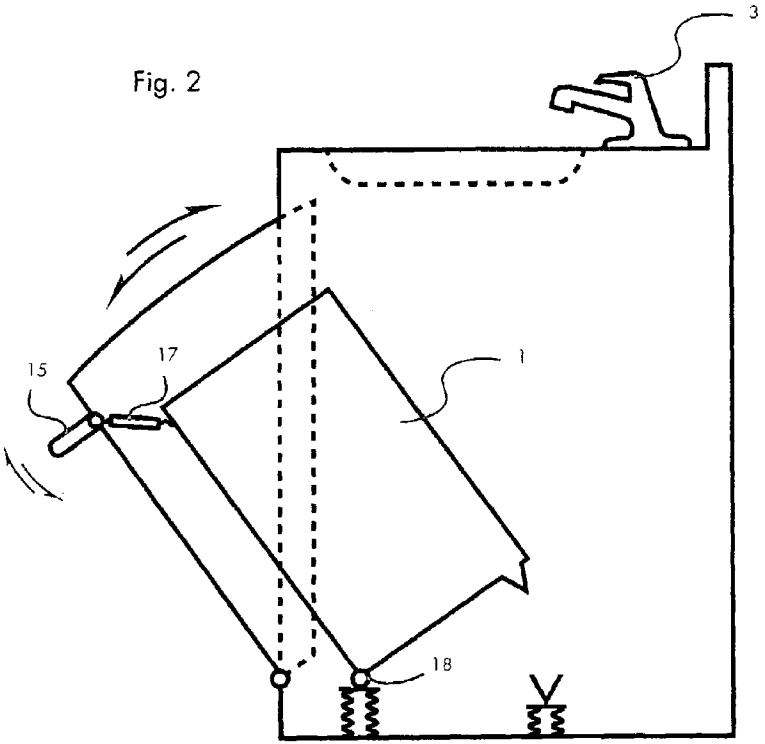
FIG. 2 is an illustrative view of drum and front panel swings open.

The check valve 11 prevents bad drain line's smell from returning back to dryer. In preferred embodiment (see FIG. 1) the drum 1 and adjacent laundry related mechanics are permanently suspended inside of the cabinet 4. However, it could be mounted pivotally or removable. This gives customer convenience of better access for loading/unloading operations by removing the laundry (drum section) out of the sink by sliding out of the cabinet (like a drawer), rotation around vertical axle (like a door) or rotation around horizontal axle 18 (like on FIG. 2).

In order to minimize the force required for relocation of the drum while assuring the safety of operations a motion-absorbing device 17 is connected between the drum 1 and a front door 12. A position-securing device (bar) 15, which is connected to the front door, allows locking the door in any position and prevents the drum from rotation when the door is open. When door is closed the bar 15 is pushed down.

Flexible P-trap 5 is positioned flush to the wall 6, which assures reliable connection during vibration and gives more space for a drum 1.

In order to decrease vibration of the cabinet the lower part of a P-trap made with tank-like expansion 13, which accumulates a few gallons of running water. This expansion 13 is attached to the cabinet and increases its weight and stability. In addition the cabinet is connected to the wall with vibration-absorbing anchors.

Figure 4:
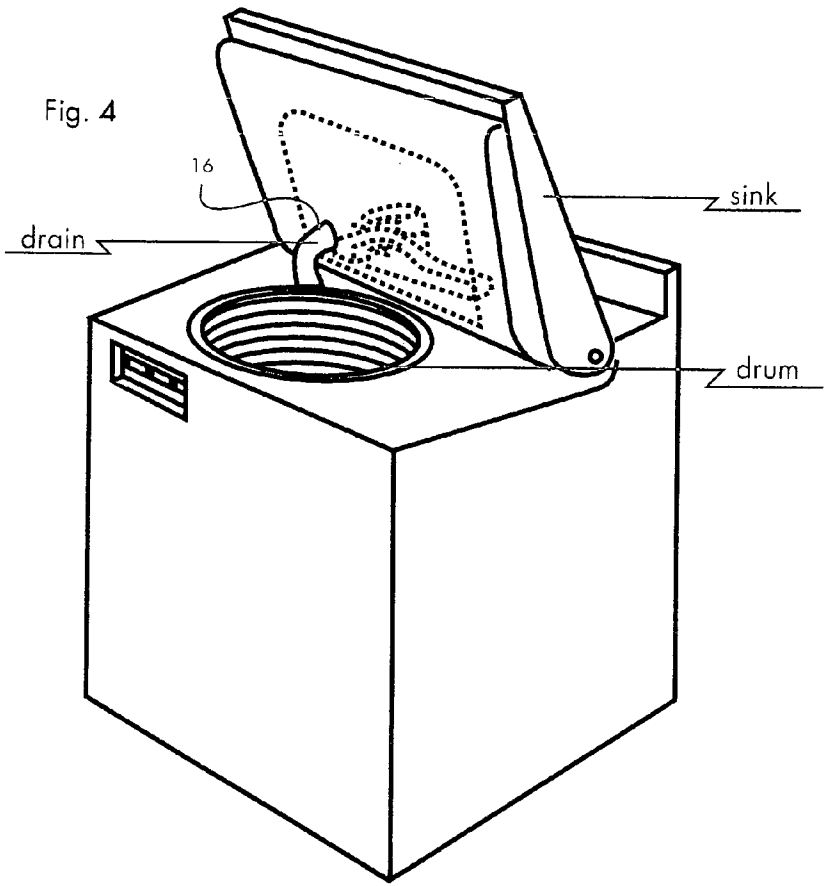
FIG. 4 is an illustrative view of pivotally mounted sink in open position.
Figure 3:
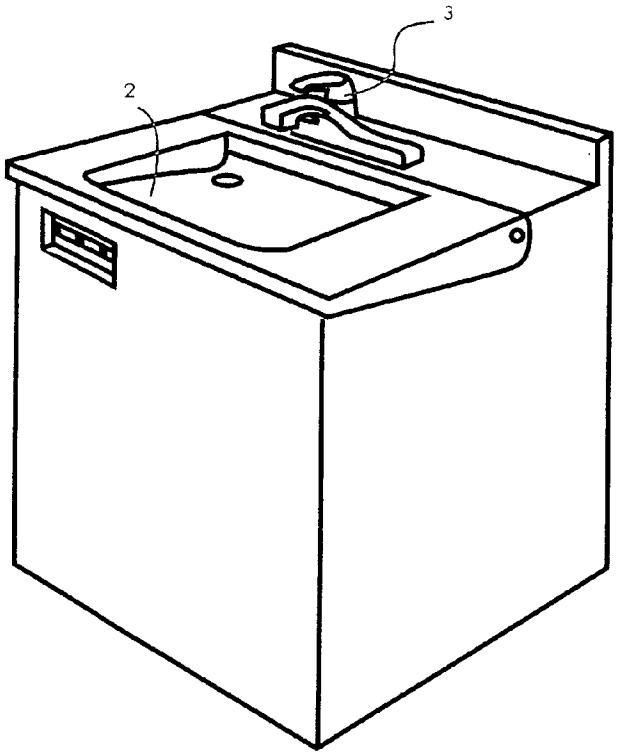
FIG. 3 is an illustrative view of pivotally mounted sink in closed position.

In different embodiment (see FIGS. 3 & 4) an access to the drum 1 is made by lifting the sink 2. The faucet is permanently attached to the top of the cabinet and sink is pivotally connected to horizontal axle. The water out of the sink will be drained via flexible drain line pipe 16. The drain hole of the sink could be moved off-center for space saving purposes. It could be done as well without flexible drain line pipe using pressure connection to the rigid drain line pipe under the sink.

The invention claimed is:

1. A top-load sink/laundry combo, comprising:

a cabinet;

a sink with a faucet mounted on the cabinet;

a water supply and drain line connected to the sink; and an automatic top-loading washing machine including a drum, the automatic top-loading washing machine being connected to the water supply and the drain line and being pivotally attached to a first horizontally suspended rotation axle in a bottom of the cabinet, the washing machine having a vibration-proof connection to a front panel of the cabinet, which is pivotally attached to a second horizontal rotation axle on the front of the cabinet.

2. The top-load sink/laundry combo defined in claim 1 wherein said automatic top-loading washing machine includes a heater for drying.

3. The top-load sink/laundry combo defined in claim 2 wherein said sink/laundry combo has the built-in P-trap having a tank-like lower portion positioned to reduce vibration of the cabinet.

4. The top-load sink/laundry combo defined in claim 2 further including ventilation means directly connected to the drain line and bypassing the P-trap.

5. The top-load sink/laundry combo defined in claim 1 wherein said sink/laundry combo has a built-in P-trap having an expansion tank-like lowering lower portion positioned to reduce vibration of the cabinet.

6. A top-load sink/laundry combo, comprising:

a cabinet;

a sink with a faucet mounted on a top of the cabinet;

a water supply and a drain line connected to the sink;

an automatic top-loading washing machine, which is connected to the water supply and the drain line and is pivotally attached to a horizontally suspended rotation axle in a bottom of the cabinet, the sink/laundry combo including a built-in P-trap, which is mounted flush to a wall positioned adjacent the cabinet, the P-trap including a lower expansion portion positioned to lower vibration of the cabinet.

7. The top-load sink/laundry combo defined in claim 6 wherein said automatic top-loading washing machine is fitted with a heater for drying.

8. The top-load sink/laundry combo defined in claim 7 further including ventilation means directly connected to the drain line and bypassing P-trap.

* * * * *